US005425301A

United States Patent [19]

Kriebel

[11] Patent Number: 5,425,301

[45] Date of Patent: Jun. 20, 1995

[54] METHOD OF STABILIZING AN UNDERWATER MISSILE

[75] Inventor: Anthony R. Kriebel, Menlo Park, Calif.

[73] Assignee: Westinghouse Electric Corporation, Pittsburgh, Pa.

[21] Appl. No.: 772,513

[22] Filed: Sep. 4, 1985

[51] Int. Cl.[6] ..... F41F 3/07
[52] U.S. Cl. ..... 89/1.809
[58] Field of Search ..... 89/1.809, 1.810, 1.8; 114/20 R

[56] References Cited

U.S. PATENT DOCUMENTS 3,892,194 7/1975 Goedde et al. ..... 89/1.809 X
4,549,464 10/1985 Hawkins et al. ..... 89/1.810 X
5,070,761 12/1991 Fidler ..... 89/1.809

*Primary Examiner*—Charles T. Jordan
*Assistant Examiner*—Theresa M. Wesson

[57] ABSTRACT

A method for improving the stability and trajectory of a missile launched from a submarine traveling underwater by positioning the venting means adjacent the nose cone so that a blanket of air is formed on the leeward side of the missile (relative to the direction the submarine is traveling) allowing the missile to be launched while the submarine is traveling near or at patrol speeds without slowing down much if at all.

6 Claims, 1 Drawing Sheet

METHOD OF STABILIZING AN UNDERWATER MISSILE

GOVERNMENT RIGHTS

The United States Government has rights in this invention in accordance with the terms of Contract No. N0003084-C-0105 between Westinghouse Electric Corporation and the Department of Defense.

BACKGROUND OF THE INVENTION

This invention relates to undersea launching of missiles from a submarine moving nearly normal to the centerline of the missile and more particularly to a method of stabilizing the missile to allow it to be launched from a submarine moving at high speed.

Submarine launched missiles are unstable as they travel through the water as the net lateral force (caused by angle of attack, pitching motion, and lateral acceleration) acts forward of the missile's center of gravity. For this reason, missiles have a tendency to pitch back after they are launched vertically from a submarine moving forward through the water.

Computer simulation and model tests have shown that if the missile centerline is slightly cambered as shown in U.S. Pat. No. 3,892,194, the lateral force associated with crossflow can be reduced to approach zero. However, the detachable nose cone camber overlay described therein must be jettisoned after the missile leaves the water.

SUMMARY OF THE INVENTION

In general, a method for launching a missile having a nose cone and a cylindrical body from a launch tube in a submarine traveling underwater, when made in accordance with this invention, comprises the steps of: pressurizing the launch tube and missile prior to launch, increasing the pressurization proportional to increasing the depth of the submarine beneath the surface of the water, providing venting means in the missile adjacent the juncture of the nose cone and the cylindrical body so that the venting means only extends around a portion of the circumference of the missile, positioning the missile in the submarine so that at least a portion of the venting means is disposed to face the stern of the submarine and providing venting means which forms a continuous blanket of gases over a portion of the missile as it approaches the surface during launch to provide a stable flight of the missile towards the surface as the submarine travels at high speed through the water.

BRIEF DESCRIPTION OF THE DRAWINGS

The object and advantages of this invention will become more apparent from reading the following detailed description in conjunction with the accompanying drawings, in which.

DESCRIPTION OF THE PREFERRED EMBODIMENT

Figure 2:
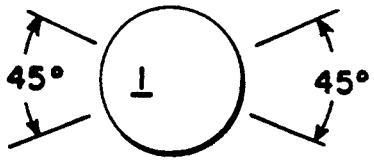
FIG. 2 is a plan view of the missile showing the extent of the venting means.
Figure 1:
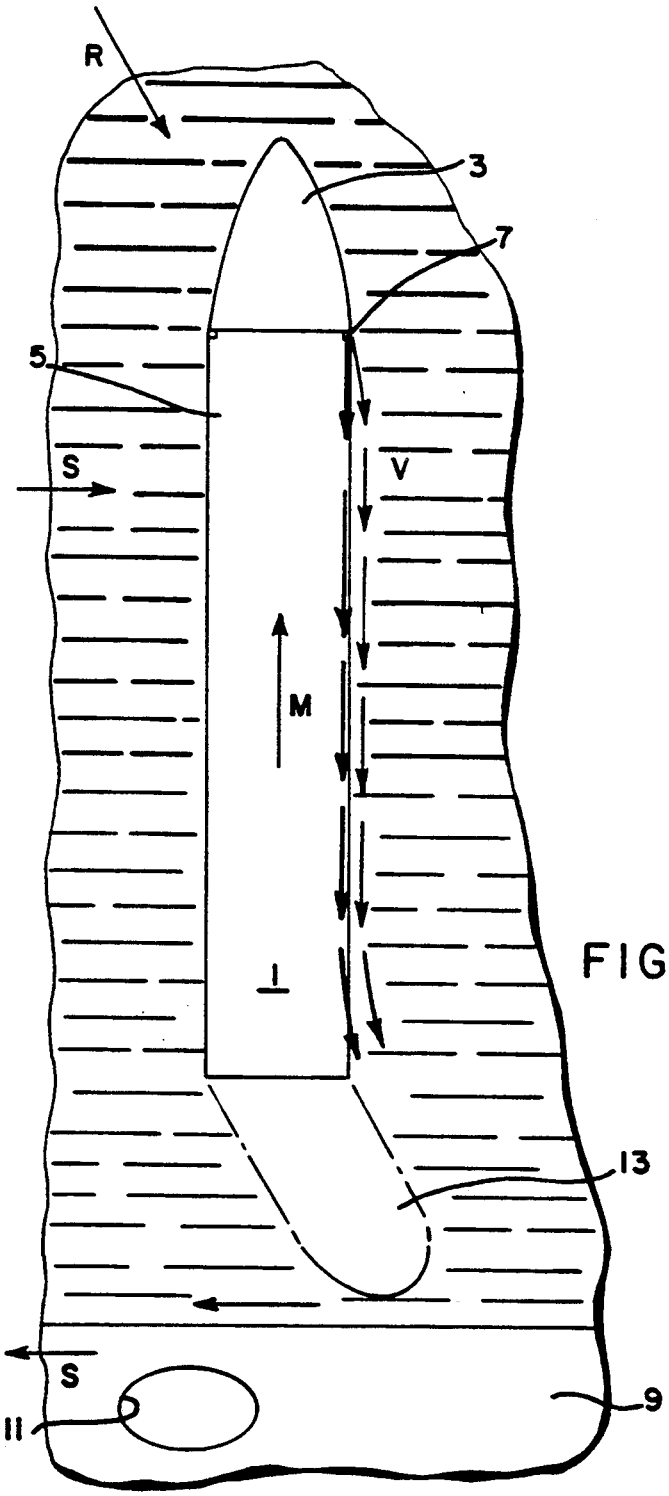
FIG. 1 is a schematic view of a missile rising through the water after launch.
Figure 3:
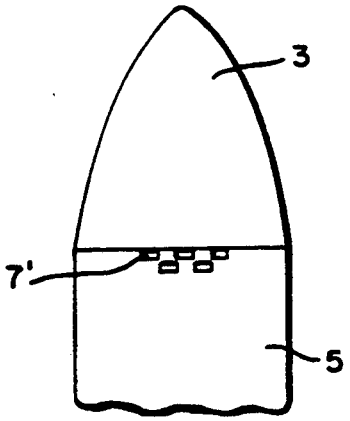
FIG. 3 is a partial elevation view of a missile showing alternative venting means.

Referring now to the drawings in detail and in particular to FIG. 1 there is shown a missile 1 having a nose cone portion 3 and a cylindrical body portion 5. Disposed adjacent the juncture of the nose cone portion 3 and the body portion 5 is venting means 7 which extends circumferentially about 45° on opposite sides of the missile as shown in FIG. 2 generally on the bow and stern side of the missile relative to a submarine in which the missile is stored. The venting means 7 as shown in FIG. 1 may be slots extending circumferentially about 45° or it may be a plurality of slots, openings or apertures 7' as shown in FIG. 3. The missiles 1 are stored in launch tubes 11 which are pressurized prior to launching, the venting means 7 or 7' equalize the pressure within the missile with the pressure in the launch tubes 11.

FIG. 1 also shows the missile after it is launched from the submarine 9. The vector S indicates the relative velocity of the submarine through the water, the vector M indicates the velocity of the missile relative to the submarine, the vector R indicates the relative velocity of the water with respect to the missile due to the velocities of the submarine and missile and the angle of attack of the water with respect to the missile as the missile moves upwardly through the water. A tail bubble is indicated by the reference numeral 13 and the vectors V show the flow of gases from the venting means 7 as they blanket the leeward side of the missile.

The method of launching a missile from a submarine traveling through the water at high speed comprises the steps of:

pressurizing the launch tube 11 and missile 1 prior to launching, the pressurization increasing proportional to the increased depth of the submarine 9 beneath the surface of the water;

providing venting means 7 or 7' in the missile 1 adjacent the juncture of the nose cone 3 and the body 5, the venting means only extending around a portion of the circumference of the missile, generally extending 45° in the bow and stern portions of the missile (bow and stern referring to the respective ends of the submarine), the venting means also being adapted to form a continuous blanket of gases over a portion of the missile as it progresses through the water to the surface by having the apertures closely spaced, overlapped or forming a large continuous slot; and placing the venting means on the leeward side of the missile to form the gas blanket thereon or by placing the venting means on the leeward and windward side of the missile (windward being the side of the missile facing the bow of the submarine as it travels through the water).

Due to the angle of attack of the missile with respect to the water, as indicated by the vector R, the windward venting means are subjected to higher pressure than the leeward venting means resulting in the pressurizing gases or air in the missile venting mainly through the leeward venting means so that the missile is stabilized and can be launched from a submarine moving at high speed through the water.

This invention is based on tests run to determine why two similar missiles had markedly different degrees of stability. It was found that the less stable missile had venting means which produced rivulets of air bubbles which were maintained as separate streams generally along the entire length of the missile and did not coalesce until they were adjacent the tail of the missile, whereas the more stable missile had venting means which blanketed the missile with vented air. It was postulated that by tailoring the location of the venting means and resultant blanket of air the trajectory of the missile could be controlled. Further tests proved this to be so and therefore by placing the venting means so that the blanket of air extends along the leeward side of the missile the trajectory of the missile through the water can be tailored to allow the missile to be launched when the submarine is traveling at high speeds through the water. Thus the submarine need no longer slow down as much (if at all) in order to launch the missile making the submarine less vulnerable and not giving an indication that the submarine is about to fire its missiles.

What is claimed is:

1. A method of launching a missile having a nose cone and a cylindrical body from a launch tube in a submarine traveling underwater comprising the steps of:

pressurizing the launch tube and missile prior to launching;

increasing the pressurization proportional to increasing depth of the submarine beneath the surface of the water;

providing venting means in the missile adjacent the juncture of the nose cone and the cylindrical body so that the venting means only extends around a portion of the circumference of the missile;

positioning the missile in the submarine so that at least a portion of the venting means is disposed to face the stern of the submarine;

providing venting means which forms a continuous blanket of gases over a portion of the missile as it approaches the surface during launch to provide a stable flight of the missile toward the surface as the submarine travels at high speed through the water.

2. The method as set forth in claim 1 wherein the step of providing venting means which form a continuous blanket of gases comprises providing venting means which has a plurality of openings cooperatively associated to produce a blanket of vented gases over a portion of the cylindrical body as the missile travels through the water.

3. The method set forth in claim 1, wherein the step of providing venting means comprises providing venting means which generally extend around one-quarter of the circumference of the cylindrical body of the missile.

4. The method as set forth in claim 3, wherein the step of providing venting means which forms a continuous blanket of gases comprising a venting means which has a plurality of openings cooperatively associated to produce a blanket of vented gases over a portion of the cylindrical body as the missile travels through the water.

5. The method as set forth in claim 3, wherein the step of providing the venting means comprises providing venting means which extends generally around one-eighth of the circumference of the missile on opposite sides thereof.

6. The method as set forth in claim 5, wherein the step of providing venting which forms a continuous blanket of gases comprises a venting means which has a plurality of openings cooperatively associated to produce a blanket of vented gases over a portion of the cylindrical body as the missile travels through the water.

* * * * *